US005839215A

United States Patent [19]

Lasprogata

[11] Patent Number: 5,839,215

[45] Date of Patent: Nov. 24, 1998

[54] RAISED INDICIA LABELS

[76] Inventor: Denise L. Lasprogata, 329 Bryan St., Havertown, Pa. 19083

[21] Appl. No.: 775,010

[22] Filed: Dec. 27, 1996

[51] Int. Cl.[6] ..... G09F 3/10

[52] U.S. Cl. ..... 40/299.01; 40/666.04; 434/113

[58] Field of Search ..... 40/301, 299.01, 40/666.04, 586; 434/112, 113

[56] References Cited

U.S. PATENT DOCUMENTS

| | | | |
|---|---|---|---|
| 4,096,655 | 6/1978 | Ullman, Jr. | 40/299 |
| 4,344,240 | 8/1982 | Schiller | 40/301 X |
| 4,404,764 | 9/1983 | Willis et al. | 40/124 |
| 5,118,390 | 6/1992 | Snow et al. | 162/123 |
| 5,286,204 | 2/1994 | Minardi | 434/113 |
| 5,367,809 | 11/1994 | Ross | 40/668 |
| 5,512,122 | 4/1996 | Sokyrka | 156/275.5 |

FOREIGN PATENT DOCUMENTS

| | | | |
|---|---|---|---|
| 59-89369 | 5/1984 | Japan . | |
| 3-278084 | 9/1991 | Japan . | |
| 193470 | 2/1923 | United Kingdom | 434/113 |
| 2011145 | 8/1982 | United Kingdom | 434/113 |

*Primary Examiner*—William Stryjewski

*Attorney, Agent, or Firm*—Stephen G. Stanton; John S. Munday; Munday and Stanton

[57] ABSTRACT

A label for attachment to clothing including a template having raised indicia thereon. The label is attached during manufacture of the article of clothing, by the store or other vending establishment, or by the purchaser at any time after acquisition of the clothing. The indicia conveys information relating to characteristics of the clothing. The raised indicia is unaffected by normal usage such as folding, crumpling or washing of the label. The indicia may comprise lettering, Braille or both forms of raised writing, as well as designs, logos or other symbols. One embodiment of the invention includes a template having indicia thereon relating to characteristics of the subject colors. The template comprises a plurality of colors identified by indicia and connected by a line or other device for specifying the relative proportion of the plurality of colors. A preferred way to specify the relative proportions of the plurality of colors includes a scale for tactile representation of the specific color in relation to the plurality of colors.

14 Claims, 3 Drawing Sheets

RAISED INDICIA LABELS

FIELD OF THE INVENTION

The present invention relates to labels and to articles of clothing having labels for use by sight impaired or blind persons. More particularly, this invention relates to clothing labels manufactured from a tactile imaging paper having raised indicia relating to characteristics of the article of clothing. These labels are unaffected by normal usage such as washing, folding and crumpling to allow sight impaired or blind persons to tactually comprehend the information conveyed by the indicia. A method and article is also provided to permit sight impaired persons, and others, to discern color relationships such as complimentary colors, and color saturation, such as shades of gray.

BACKGROUND OF THE INVENTION

Sight impaired or blind people face many challenges and obstacles as they seek to function as sighted persons in society. One problem area usually overlooked is clothing and fashion. Clothing is mandated to include labels listing the fabric(s) from which the specific article of clothing is made. The labels may also include care instructions for cleaning or laundering. For the visually impaired such labels can not be deciphered without assistance. Moreover, such labels do not indicate the color, cut, style, etc. of the clothing as this information is readily apparent to those not visually impaired. Further, sight impaired persons may not easily discern relationships between colors or color saturation. For example complimentary colors and shades of gray range from white through black and such a discernment would be of great advantage.

To overcome these limitations and shortcomings, many times the visually impaired press Braille into slips of paper or plastic which are pinned to articles of clothing to identify their clothes so that they can dress in coordinated colors, cuts, styles, etc. However, these makeshift labels must either be removed each time the clothing is worn or washed, or else normal usage, such as folding, crumpling or washing, degrades or destroys the label so that they no longer are decipherable. Another drawback to self-made labels is that the Braille lettering collects dirt in the indented reverse side.

Another limitation is that when clothing is initially purchased, the store labels can not be deciphered without sight. Thus the visually impaired person must have assistance in choosing the proper size, color, cut, style, etc. at the point of purchase. Not only is this inconvenient and requires the aid of a friend or salesperson having the necessary time and patience, but it constrains the independence and freedom for the visually impaired person. In any event, the visually impaired person must then prepare the necessary Braille labels for the articles of clothing purchased.

Accordingly, it is an object of the present invention to provide a label having raised indicia relating to certain characteristics of the object to which the label is permanently affixed that allows visually impaired persons to tactually read the labels.

Another object of this invention is to provide a label having raised indicia that is unaffected by normal usage such as folding, crumpling, or washing to still permit visually impaired persons to tactually read the labels.

Yet another object of the present invention is to provide an article of clothing having a label including raised indicia relating to characteristics of the clothing such that a visually impaired person may tactually read the label.

A further object of the present invention is to provide a method and article to allow sight impaired persons, and others, to readily discern the relationships between colors, e.g. complimentary colors, and color saturation, e. g. shades of gray.

Other objects will appear hereinafter.

SUMMARY OF THE INVENTION

It has now been discovered that the above and other objects of the present invention may be accomplished in the following manner. Specifically, the present invention provides raised indicia clothing labels made from tactile imaging materials that are capable of being imprinted with tactile images on one side of the material without concomitant indentations on the other side.

One such material is FLEXI-PAPER™ tactile imaging paper manufactured by Repro-Tronics Inc. of Westwood, N.J. It has been discovered that labels made by producing raised indicia labels by the use of Repro-Tronics Inc.'s TACTILE IMAGE ENHANCER™ machine produces a significantly improved label for use by sight impaired persons. Other tactile imaging materials of cloth, plastic and paper may also be used.

The tactile imaging material allows for printing of raised images that withstand repeated folding, crumpling and washings without affecting the raised images. It has been discovered that a tactile imaging material such as the FLEXI-PAPER imaging paper so printed is admirably suited for permanently affixed labels for clothing with raised indicia for use by sight impaired persons. Normal use and repeated washings of the clothing does not affect the raised indicia such that sight impaired persons may rely on the labels to convey information regarding the characteristics and care instructions for the clothing to permit such persons to independently appropriately dress and care for the clothing.

The labels so produced include raised Braille indicia and may include raised word indicia in English or other languages sized to permit tactile reading by sight impaired persons. The indicia conveys various characteristics of the clothing for which the label is to be attached such as size, style, color, cut, etc. Care instructions for the garment may also be included as well as the brand name of the garment.

The labels so produced may also include raised images in a wheel and spoke relationship with complimentary colors at opposite ends of the respective spokes and distinctive raised symbols for each color to allow sight impaired persons to easily discern the colors on the color wheel and their relationships. Such color wheels may be used independently from the clothing labels to teach sight impaired persons color relationships.

The labels so produced may further include a raised color saturation diagram consisting of several adjacent cells having greater number of horizontal raised lines extending from the top or bottom of each cell as the cells progress from left to right such that in a six cell diagram Two reference color raised symbols or raised names in Braille or English corresponding to those colors are placed at the left and right end of the color saturation diagram, respectively. The subject color raised indicia symbol is placed at the far left hand side of the color saturation diagram and is also placed immediately below the diagram at a position between the reference colors corresponding to the specific color or shade of color to be conveyed to the sight impaired person.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
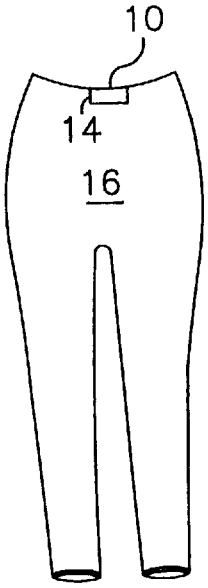
FIG. 1 is a schematic view of an article of clothing having a label made in accordance with the present invention.
Figure 2:
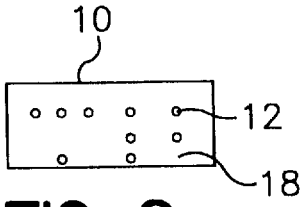
FIG. 2 is an enlarged schematic view of a label having Braille indicia made in accordance with the present invention.
Figure 3:
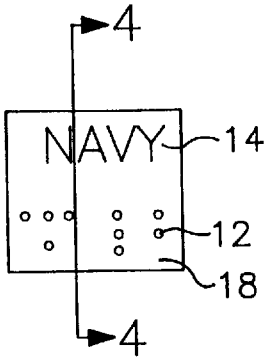
FIG. 3 is an enlarged schematic view of a label having English lettering indicia made in accordance with the present invention.

As shown in the drawings, a label 10 in accordance with the present invention includes raised indicia 12 in FIG. 2 and raised indicia 14 in FIG. 3. FIG. 1 shows label 10 affixed to an article of clothing 16, although the label may be attached at any location on the garment.

FIG. 2 is an enlarged view of the label 10 of FIG. 1, showing raised Braille indicia 12. Indicia 12 relates provides specific information such as size, color, fabric, and the like that relate to the characteristics of the article of clothing 16.

FIG. 3 is an alternative enlarged view of a label 10*a*, having raised English indicia 14. Indicia 14 also describe one or more of the characteristics of clothing 16.

Figure 4:
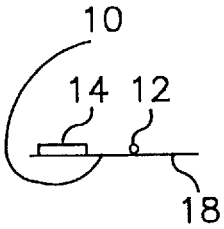
FIG. 4 is a side elevational view taken along line 4,4 of FIG. 3.

FIG. 4 is a side elevational view taken along line 4,4 of FIG. 3 showing the manner in which the raised English indicia 14 rise above imaging paper 18. The indicia 14 is sized to permit a sight impaired person to easily distinguish and tactually read the indicia.

The labels 10 or 10*a* may be made from imaging paper 18. One source of paper 18 is manufactured and sold as FLEXI-PAPER™ tactile imaging paper by Repro-Tronics Inc. of Westwood, N.J. The FLEXI-PAPER imaging paper is a polyethylene based paper having a microelectrode coating. A machine known as the TACTILE IMAGE ENHANCER™ machine, also manufactured and sold by Repro-Tronics Inc., is used to produce the raised indicia for the labels 10. Such FLEXI-PAPER imaging paper is currently sold mostly to schools for educational diagrams such as science models. The labels 10 so produced resist folding, crumpling, washings and temperatures up to 200° F. and so are ideal for permanent attachment to clothing.

As noted, other tactile imaging materials of cloth, plastic and paper may also be used. All that is required is that the tactile imaging materials be capable of being imprinted on one side of the material preferably without concomitant indentations on the other side.

The label may be attached during manufacture of the article of clothing, by the store or other vending establishment, or by the purchaser at any time after acquisition of the clothing. The indicia may comprise lettering, Braille or both forms of raised writing, as well as designs, logos or other symbols.

Figure 5:
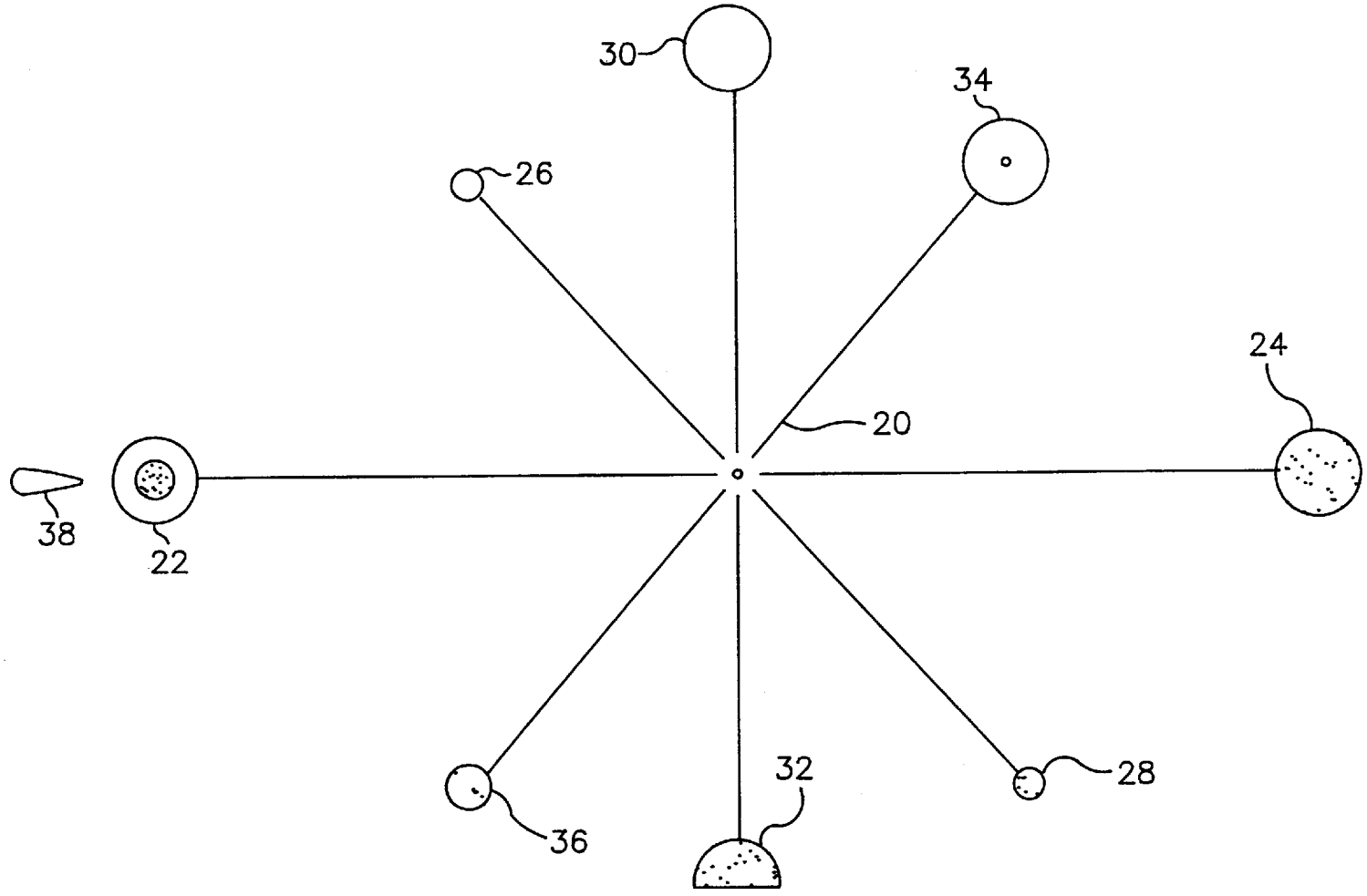
FIG. 5 is a schematic diagram of a raised indicia color wheel made in accordance with the present invention.

As shown in FIG. 5, a raised indicia color wheel 20 may be produced from the labels showing a wheel and spoke arrangement whereby the complimentary color raised indicia pairs: white 22 - black 24; violet 26 - yellow 28; red 30 - green 32; and orange 34 - blue 36 are placed at the opposite ends of the respective spokes. Each color is represented by a distinctive raised indicia symbol to differentiate it from another color so a sight impaired person may readily discern the colors and be able to further appreciate the relationship and differences between colors. A tear-dropped raised symbol 38 is placed on its side at the left edge and pointing towards the color wheel to signify to a sight impaired person a place of beginning or orientation.

Figure 6A:
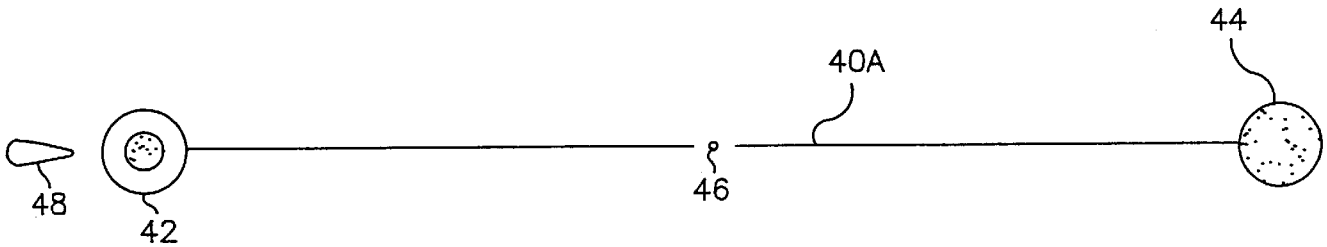
FIGS. 6A, 6B and 6C are schematic views of a raised indicia color saturation diagram, all in accordance with the present invention.

As shown in FIG. 6, a raised indicia color saturation diagram 40A, 40B, 40C may be produced from the labels. For example, FIG. 6A is a simple line between the raised indicia color symbols white 42 on the left, black 44 on the right and showing the raised indicia color symbol gray 46 in the center and is identical to the single white - black spoke of the color wheel of FIG. 5. A tear-dropped raised symbol 48 is placed on its side at the left edge and pointing towards the color saturation diagram to signify to a sight impaired person a place of beginning or orientation.

Figure 6B:
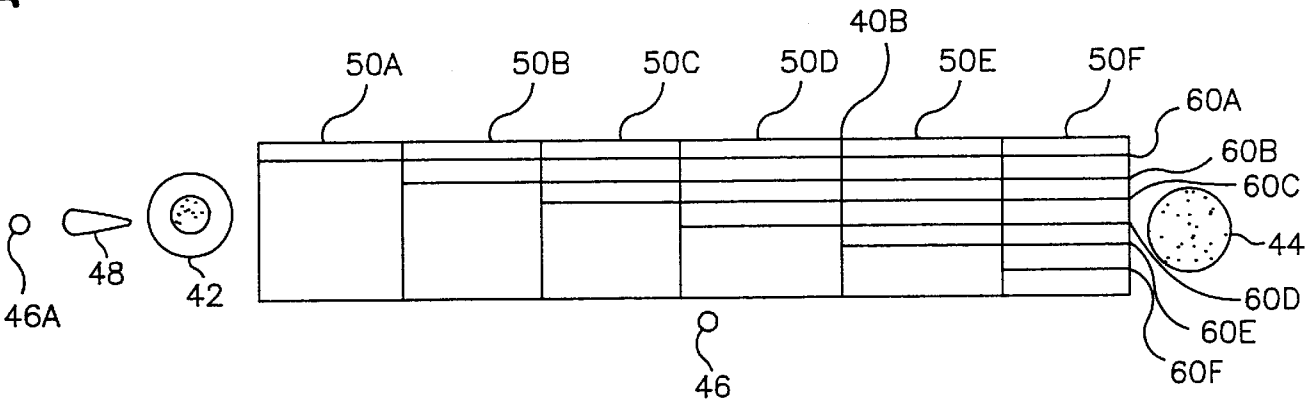

FIG. 6B illustrates an alternative color saturation diagram and consists of several adjacent cells (50A, 50B, 50C, 50D, 50E, 50F) having greater number of horizontal raised lines (60A, 60B, 60C, 60D, 60E, 60F) extending from the top, or alternatively the bottom, of each cell as the cells progress from left to right such that in a six cell diagram, for example, the leftmost cell has one horizontal line (60A) in addition to the top and bottom horizontal cell lines, the second has two (60A, 60B), the third three (60A, 60B, 60C), . . . and the sixth has six (60A, 60B, 60C, 60D, 60E, 60F) such raised horizontal lines. Two color raised symbols or raised names in Braille or English corresponding to two reference colors, white and black (42, 44) in FIG. 6B, are placed at the left and right end of the color saturation diagram, respectively. The symbol for the subject color, gray (46A) in FIG. 6B, is placed to the far left of the color saturation diagram just before the tear-drop shaped start/orientation raised symbol (48). Then the specific shade or color saturation of the subject color raised indicia symbol (46) is positioned immediately below the color saturation diagram at a position corresponding to the color saturation between the two reference colors.

Therefore a sight impaired person may discern the shade of gray of a particular piece of clothing or a painting, etc. For example if the gray raised indicia symbol 46 were positioned below the diagram in the middle between the white and black symbols 42, 44 such as in FIG. 6B, a sight impaired person could readily determine that the subject color of the piece of clothing or color in a painting would be a mid-gray. If the gray symbol 46 were placed to the far left of the diagram, that would represent addition of a substantial amount of white to show a very light gray or an off-white shade. Thus sight impaired persons are able to more clearly appreciate or determine different clothing colors or different colors in a painting, for example.

Figure 6C:
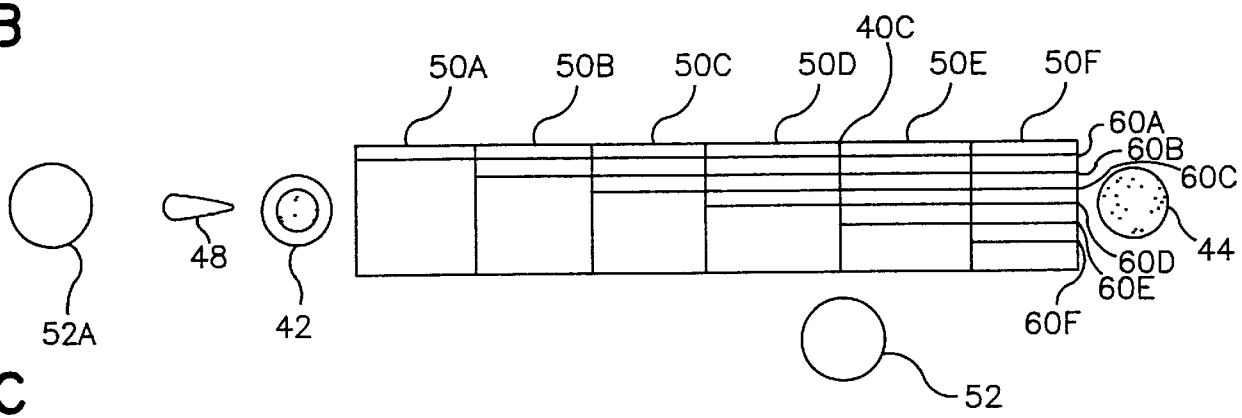

FIG. 6C demonstrates the use of using red as the subject color in a white-black reference color saturation diagram. FIG. 6C shows pure red unmixed with either white or black. If the red color indicia 52 were instead placed to the far left of the diagram near the first cell, that would represent addition of a substantial amount of white to show a very light red or a pink shade. If the red color indicia 52 were instead placed to the far right of the diagram near the last cell, that would represent addition of a substantial amount of black to show a very dark or deep shade of red. Thus the color saturation diagram of the present invention allows for a simple, quick and effective method of conveying to sight impaired persons different saturations of colors of clothing, paintings, scenery, etc.

While particular embodiments of the present invention have been illustrated and described, it is not intended to limit the invention, except as defined by the following claims.

I claim:

1. A label for attachment to clothing, comprising:

a label formed from a tactile imaging material, said material having raised information conveying indicia thereon providing characteristics of the clothing, said raised indicia being unaffected by normal folding, crumpling or washing of the label.

2. The label of claim 1, wherein said indicia comprises lettering.

3. The label of claim 1, wherein said indicia comprises Braille.

4. The label of claim 1, wherein said indicia comprises Braille and raised lettering.

5. An article of clothing having a label for use by a sight impaired person, comprising:

an article of clothing; and a label formed from a tactile imaging material and fixedly affixed to said article of clothing, said label having raised indicia on said label conveying information about said clothing, said raised indicia being unaffected by normal folding, crumpling or washing of the article of clothing.

6. The article of clothing of claim 5, wherein said tactile imaging material comprises a tactile imaging paper.

7. The article of clothing of claim 5, wherein said indicia comprises lettering.

8. The article of clothing of claim 5, wherein said indicia comprises Braille.

9. The article of clothing of claim 5, wherein said indicia comprises Braille and raised lettering.

10. A method of identifying characteristics of an article of clothing by a sight impaired person, comprising the steps of:

forming a label from a tactile imaging material;

placing raised information conveying indicia on said label, said indicia providing characteristics of the article of clothing and being unaffected by normal folding, crumpling or washing of the article of clothing; and fixedly attaching said label to the article of clothing for perception by the sight impaired person.

11. The method of claim 10, wherein said tactile imaging material comprises a tactile imaging paper.

12. The method of claim 10, wherein said indicia comprises lettering.

13. The method of claim 10, wherein said indicia comprises Braille.

14. The method of claim 10, wherein said indicia comprises Braille and raised lettering.

* * * * *